US011001916B2

(12) United States Patent
Santacreu et al.

(10) Patent No.: US 11,001,916 B2
(45) Date of Patent: May 11, 2021

(54) METHOD FOR MANUFACTURING A MARTENSITIC STAINLESS STEEL PART FROM A SHEET

(71) Applicant: APERAM, Luxembourg (LU)

(72) Inventors: Pierre-Olivier Santacreu, Isbergues (FR); Christophe Cazes, Versailles (FR); Guillaume Badinier, Lille (FR); Jean-Benoit Moreau, Lille (FR)

(73) Assignee: APERAM, Luxembourg (LU)

( * ) Notice: Subject to any disclaimer, the term of this patent is extended or adjusted under 35 U.S.C. 154(b) by 219 days.

(21) Appl. No.: 16/095,650

(22) PCT Filed: Mar. 21, 2017

(86) PCT No.: PCT/IB2017/051636
§ 371 (c)(1),
(2) Date: Oct. 22, 2018

(87) PCT Pub. No.: WO2017/182896
PCT Pub. Date: Oct. 26, 2017

(65) Prior Publication Data

US 2019/0127829 A1 May 2, 2019

(30) Foreign Application Priority Data

Apr. 22, 2016 (WO) ..... PCT/IB2016/052302

(51) Int. Cl.
*C22C 38/52* (2006.01)
*C21D 6/00* (2006.01)
(Continued)

(52) U.S. Cl.
CPC ..... *C22C 38/52* (2013.01); *C21D 1/673* (2013.01); *C21D 6/002* (2013.01); *C21D 6/004* (2013.01);
(Continued)

(58) Field of Classification Search
CPC ..... C22C 38/52; C22C 38/06; C22C 38/42; C22C 38/44; C22C 38/46; C22C 38/48;
(Continued)

(56) References Cited

U.S. PATENT DOCUMENTS

2010/0276038 A1* 11/2010 Grellier ..... C21D 1/22 148/542
2018/0127858 A1* 5/2018 Chassagne ..... C21D 8/1222
(Continued)

FOREIGN PATENT DOCUMENTS

CA 2869798 A1 5/2015
EP 0170598 A1 2/1986
(Continued)

OTHER PUBLICATIONS

International Search Report issued by the International Searching Authority in International Application No. PCT/IB2017/051636, dated May 22, 2017, 4 pages total.

*Primary Examiner* — Scott R Kastler
(74) *Attorney, Agent, or Firm* — Troutman Pepper Hamilton Sanders LLP

(57) ABSTRACT

A method for manufacturing a martensitic stainless steel part, according to which a stainless steel sheet is prepared with the following composition: 0.005%≤C≤0.3%; 0.2%≤Mn≤2.0%; traces≤Si≤1.0%; traces≤S≤0.01%; traces≤P≤0.04%; 10.5%≤Cr≤17.0%; traces≤Ni≤4.0%; traces≤Mo≤2.0%; Mo+2×W≤2.0%; traces≤Cu≤3%; traces≤Ti≤0.5%; traces≤Al≤0.2%; traces≤O≤0.04%; 0.05%≤Nb≤1.0%; 0.05%≤Nb+Ta≤1.0%; 0.25%≤(Nb+Ta)/(C+N)≤8; traces≤V≤0.3%; traces≤Co≤0.5%; traces≤Cu+Ni+Co≤5.0%; traces≤Sn≤0.05%; traces≤B≤0.1%; traces≤Zr≤0.5%; Ti+V+Zr≤0.5%; traces≤H≤5 ppm; traces≤N≤0.2%; (Mn+Ni)≥(Cr−10.3−80×[(C+N)$^2$]); traces≤Ca≤0.002%; traces≤rare earth and/or Y≤0.06%; and the rest being iron and impurities.

17 Claims, 2 Drawing Sheets

(51) Int. Cl.

| | |
|---|---|
| ***C21D 7/13*** | (2006.01) |
| ***C21D 1/673*** | (2006.01) |
| ***C22C 38/00*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 6/005* (2013.01); *C21D 6/007* (2013.01); *C21D 6/008* (2013.01); *C21D 7/13* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/004* (2013.01); *C21D 2211/005* (2013.01); *C21D 2211/008* (2013.01)

(58) Field of Classification Search

CPC ... C22C 38/001; C22C 38/002; C22C 38/004; C22C 38/005; C22C 38/008; C22C 38/02; C22C 38/04; C22C 38/50; C21D 6/004; C21D 6/005; C21D 6/007; C21D 6/008; C21D 7/13; C21D 1/673

See application file for complete search history.

(56) References Cited

U.S. PATENT DOCUMENTS

| | | | | |
|---|---|---|---|---|
| 2019/0040506 | A1* | 2/2019 | Nishida | C21D 1/25 |
| 2019/0127829 | A1* | 5/2019 | Santacreu | C22C 38/005 |
| 2019/0300981 | A1* | 10/2019 | Zhang | C22C 38/46 |

FOREIGN PATENT DOCUMENTS

| | | | |
|---|---|---|---|
| FR | 2920784 | A1 | 3/2009 |
| JP | S58123822 | A | 7/1983 |

* cited by examiner

METHOD FOR MANUFACTURING A MARTENSITIC STAINLESS STEEL PART FROM A SHEET

CROSS-REFERENCE TO RELATED APPLICATIONS

This is a U.S. national phase application under 35 U.S.C. § 371 of International Patent Application No. PCT/IB2017/051636, filed Mar. 21, 2017, which claims priority to International Application No. PCT/IB2016/052302, filed Apr. 22, 2016. The entire contents of these applications are hereby incorporated by reference.

The invention relates to the hot forming of stainless steels from a sheet to give them complex shapes and exceptional mechanical properties, wherein these steels are intended, for example, for the automotive industry.

In order to lighten the weight of vehicles and so limit their fuel consumption and thus limit their $CO_2$ emissions, manufacturers today use carbon steel or stainless steel sheets with very high strength, allowing reductions in thickness of the sheet compared with the more conventional steels used in the past.

Martensitic steels (or, more generally, with more than 50% martensitic structure) have such mechanical characteristics, but their ability to be cold-formed is limited. It is therefore necessary either to cold form them in the ferritic state, and then to heat-treat the part to obtain the martensitic structure, or to heat-form them in the austenitic state and to finish the treatment with quenching in order to obtain the martensitic structure.

The production of parts with a complex geometry by this second method using known steels (carbon steels containing boron, . . . ) is, however, made difficult by the constraints of their limited hardenability, or the existence of high temperature metallurgical transformations that make it difficult to maintain good control of the progress of the shaping and tempering. There is a strong risk of obtaining a complex part that is not predominantly martensitic, and, therefore, whose mechanical characteristics do not correspond to those intended, or that the method must be limited to obtaining a martensitic part with a simple geometry, whose shape may be corrected, for example by means of laser cutting.

It is conceivable to carry out several steps of hot shaping on press transfers/tools starting from the steels conventionally known for these uses, in order to make the shaping progressive and to limit the risks of defects occurring. But the part obtained will consist of less than 80% of martensite by volume and its mechanical properties and its resilience will be degraded: wherein at least one of the targets tensile strength Rm, elastic limit Rp0.2, elongation at break A, ease of folding or resilience, will not be achieved. The time required to pass above the martensitic transformation end temperature Mf to achieve at least two shaping steps, two transfer steps and a quenching step is too long, and the austenite will be transformed partially into ferrite/carbides/perlite.

Obtaining a structure composed of a minimum of at least 80% by volume of martensite is already possible with known steels, but the cooling rate during quenching must be greater than 30° C./s on average. A multi-pass method using, after austenitization, a press with tools to follow or a transfer press will not allow more than one transfer step, followed by a shaping or hot cutting step, before quenching in the tool to guarantee a minimum cooling rate of 30° C./s.

The object of the invention is to propose a method for producing a martensitic steel part that has been heat-transformed that makes it possible to manufacture parts with a complex shape from a sheet, wherein, moreover, this final part has high mechanical properties thus making it suitable, in particular, for use in the automotive industry.

To this end, the object of the invention is a method for manufacturing a martensitic stainless steel part from a sheet by hot forming, characterized in that:

- a stainless steel sheet is prepared with the following composition in percentages by weight:
  - 0.005%≤C≤0.3%;
  - 0.2%≤Mn≤2.0%;
  - traces≤Si≤1.0%;
  - traces≤S≤0.01%;
  - traces≤P≤0.04%;
  - 10.5%≤Cr≤17.0%; preferably 10.5%≤Cr≤14.0%;
  - traces≤Ni≤4.0%;
  - traces≤Mo≤2.0%;
  - Mo+2×W≤2.0%;
  - traces≤Cu≤3%; preferably traces Cu 0.5%;
  - trace≤s Ti≤0.5%;
  - traces≤Al≤0.2%;
  - traces≤O≤0.04%;
  - 0.05%≤Nb≤1.0%;
  - 0.05%≤Nb≤+Ta≤1.0%;
  - 0.25%≤(Nb+Ta)/(C+N)≤8;
  - traces≤V≤0.3%;
  - traces≤Co≤0.5%;
  - traces≤Cu+Ni+Co≤5.0%;
  - traces≤Sn≤0.05%;
  - traces≤B≤0.1%;
  - traces≤Zr≤0.5%;
  - Ti+V+Zr≤0.5%;
  - traces≤H≤5 ppm, preferably traces≤H≤1 ppm;
  - traces≤N≤0.2%;
  - $(Mn+Ni) \geq (Cr-10.3-80\times[(C+N)^2])$;
  - traces≤Ca≤0.002%;
  - traces≤rare earths and/or Y≤0.06%;
  - the rest being iron and impurities resulting from the steelmaking;
- the martensitic transformation start temperature (Ms) of the sheet is ≥200° C.;
- the martensitic transformation end temperature (Mf) of the sheet is ≥50° C.;
- the microstructure of the sheet is composed of ferrite and/or tempered martensite and 0.5% to 5% by volume of carbides;
- the size of the ferritic grains of the sheet is from 1 to 80 μm, preferably from 5 to 40 μm;
- the method optionally comprises one or more hot and/or cold transformations of the sheet;
- the sheet is austenitized by maintaining it at a temperature greater than Ac1 in order to give it a microstructure containing at most 0.5% of carbides in volume fraction and at most 20% of residual ferrite in volume fraction;
- the austenitized sheet is transferred to a first shaping tool or a cutting tool, wherein the transfer has a duration t0, during which the sheet remains at a temperature greater than Ms and retains at most 0.5% by volume of carbides and at most 20% by volume of residual ferrite, wherein the sheet is at a temperature TP0 at the end of this transfer;
- a first stage of shaping or cutting of the sheet is carried out for a period t1, during which period the sheet remains at a temperature greater than Ms and retains at most 0.5% by volume of carbides and at most 20% by volume of residual ferrite;

a transfer of the shaped or cut sheet is carried out on a second shaping or cutting tool, or the configuration of the first shaping or cutting tool is modified for a period t2 during which period the sheet metal is cut, while remaining at a temperature greater than Ms and retaining at most 0.5% by volume of carbides and at most 20% by volume of residual ferrite;

a second step of shaping or cutting of the sheet is carried out for a time period t3, during which period the sheet remains at a temperature greater than Ms, while retaining at most 0.5% by volume of carbides and at most 20% by volume of residual ferrite;

optionally, other steps may be performed to transfer the cut or shaped sheet to other cutting or shaping tools, or to modify the configuration of the shaping or cutting tool used in the preceding step, wherein each step is followed by a shaping or cutting step, and wherein the sheet remains at a temperature greater than Ms and retains at most 0.5% by volume of carbides and at most 20% by volume of residual ferrite during each of the steps involving transferring the sheet or modifying the configuration of the tool and each of the shaping or cutting operations;

if TPn is used to denote the temperature reached by the shaped or cut sheet at the end of the final cutting or shaping step and Σti denotes the sum of the periods of the steps of the transfer and/or tool configuration change and the shaping or cutting steps, the magnitude (TP0−TPn)/Σti is at least 0.5° C./s;

optionally, an additional shaping or cutting step may be carried out at a temperature between Ms and Mf, in a state where the microstructure consists of martensite, at least 5% of austenite and at most 20% of ferrite, and the sheet is allowed to cool to ambient temperature in order to obtain the final part, wherein the final part has a microstructure containing at most 0.5% of carbides in volume fraction and at most 20% of residual ferrite in volume fraction.

The sheet may have a martensitic transformation start temperature (Ms)≤400° C.

The martensitic transformation start temperature (Ms) of the sheet may be between 390 and 220° C.

The thickness of the sheet may be between 0.1 and 10 mm.

The austenitization temperature may be at least 850° C.

The austenitization temperature may be between 925 and 1200° C.

The sheet may be reheated during at least one of the steps for the transfer and/or tool configuration change or the steps for shaping or cutting the sheet.

It is possible to perform surface treatment on the final part, which is intended to increase its roughness or its fatigue properties.

The final part may be kept between 90 and 500° C. for 10 s to 1 h, then allowed to cool naturally in air.

As it will have been understood, the invention is based on the combination:

of the choice of a stainless steel martensitic composition;

and the application of a particular hot shaping method to a sheet having this composition, as well as precise initial structural characteristics which make it possible to use the method to obtain the final part, or an intermediate part which will then undergo operations aimed at the fine optimization of some of its mechanical and/or superficial properties.

This method begins with an austenitization of the sheet, i.e. by raising its temperature above the temperature Ac1 of the steel in order to form austenite in place of ferrite and carbides constituting the starting microstructure, and under conditions which limit superficial decarburization and oxidation of the sheet as far as possible.

Then several steps (at least two) are successively performed to form the sheet under conditions of temperature and duration in order that the ferrite+carbides structure obtained after austenitization is retained throughout the shaping. If necessary, it is possible to increase or maintain the temperature between or during the shaping steps by means of heating tools, so that the temperature of the sheet being shaped and between the shaping operations (during transfers of the sheet from one tool to another, or during tool configuration changes if the sheet remains on the same tool) does not fall below Ms (the martensitic transformation start temperature).

It should be understood that the term "shaping step" includes such diverse operations as deformation or removal of material such as, in particular, deep drawing, hot stamping, swaging, cut-outs, and drilling, wherein these steps may be performed in any order decided by the manufacturer.

After shaping, the part so obtained is cooled without particular constraints on the cooling. This cooling may be preceded by a cutting or final shaping step carried out between Ms and Mf (martensitic transformation end temperature), under conditions where the microstructure consists of at least 10% of austenite and at most 20% ferrite, while the rest is martensite.

The invention will be better understood upon reading the following description that is given with reference to the following appended figures.

Figure 1:
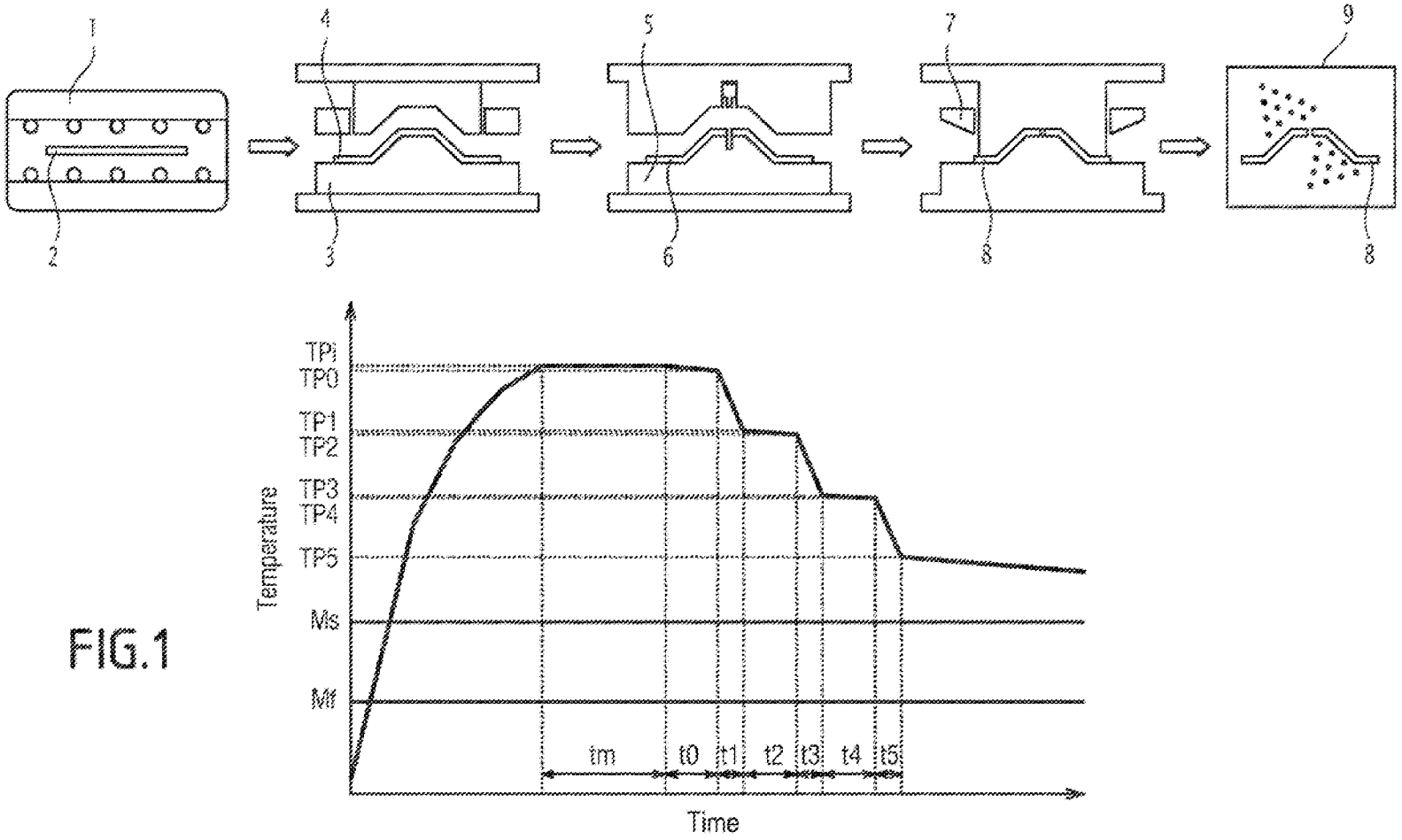
FIG. 1 shows a diagram representing the manufacture of a part making use of the method according to the invention, using a conventional roller furnace, as well as the development of the temperature of the steel during manufacture.

The composition of the martensitic stainless steel used in the method according to the invention is as follows. All percentages are percentages by weight.

Its C content is between 0.005% and 0.3%.

The minimum content of 0.005% is justified by the need to obtain austenitization of the microstructure during the first step of the hot shaping method in order to obtain the final targeted mechanical properties. Above 0.3%, the weldability and, above all, the resilience of the sheet becomes insufficient, in particular for an application in the automotive industry.

Its Mn content is between 0.2 and 2.0%.

A minimum of 0.2% is required to obtain austenitization. Above 2.0%, there is a risk of oxidation problems during heat treatments if they are not carried out in neutral or reducing atmospheres, and, moreover, the obtaining of the desired mechanical properties would no longer be guaranteed.

Its Si content is between traces (i.e. simple impurities resulting from the formulation, without Si being added) and 1.0%.

Si may be used as deoxidizer during the formulation, exactly like Al, to which it may be added or substituted. Beyond 1.0%, it is considered that Si would excessively favor the formation of ferrite and thus make it more difficult to austenitize, while Si would embrittle the sheet too much so that the shaping of a complex part would not proceed satisfactorily.

Its S content is between traces and 0.01% (100 ppm), to ensure weldability and resilience suitable for the final product.

Its P content is between traces and 0.04%, to ensure that the final product will not be excessively brittle. P is also bad for weldability.

Its Cr content is between 10.5 and 17.0%, preferably between 10.5% and 14.0% for faster carbide dissolution during austenitization.

The minimum content of 10.5% is justified to ensure the stainlessness of the sheet. A content greater than 17% would make austenitization difficult and unnecessarily increase the cost of the steel.

Its Ni content is between traces and 4.0%.

An addition of Ni is not essential to the invention. The presence of Ni within the prescribed limit of 4.0% maximum may, however, be advantageous for promoting austenitization. Exceeding the 4.0% limit, however, would lead to an excessive presence of residual austenite and an insufficient presence of martensite in the microstructure after cooling.

Its Mo content is between traces and 2.0%.

The presence of Mo is not essential. But it is favorable for a good resistance to corrosion. Above 2.0%, austenitization would be hampered and the cost of steel unnecessarily increased.

A presence of W is likewise possible, but since W is a strongly hardening element, its presence must be limited and related to the Mo content. It is considered that the sum Mo+2×W must be between traces and 2.0%.

Contrary to what is most customary when one considers the cumulation of the influences of Mo and W on a steel, it is necessary to take into account the relation Mo+2×W and not the relation Mo+W/2. The relation Mo+W/2 is to be taken into account in order to control the influence of these two elements on the formation of precipitates, for which W is twice as effective as Mo in the case of an equal added quantity. However, in the case of the invention, the respective influences of Mo and W on the hardness of the steel are favored. And since W is a stronger hardening element than Mo for equal added quantities, it is the relation Mo+2×W which must be taken into account according to the invention. This sum Mo+2×W must be between traces and 2.0%. Beyond this, the hardness becomes excessive and, all other things being equal, there is a reduction in the mechanical properties to be preferred in the context of the invention, in particular the folding angle ability and the resilience.

Its Cu content is between traces and 3.0%, preferably between traces and 0.5%.

These requirements for Cu are normal for this type of steel. In practice, this means that an addition of Cu is not useful and that the presence of this element is only due to the raw materials used. A content greater than 0.5%, which would be an optional addition, is not desirable for automotive applications as it would degrade weldability. Cu may, however, assist in austenitization, and if the steel of the invention is applied to a field which does not necessitate welding, the Cu content may be up to 3.0%.

Its Ti content is between traces and 0.5%.

Ti is a deoxidizer, like Al and Si, but its cost and lesser efficiency than that of Al, generally makes its use unattractive from this point of view. It may be of interest that the formation of Ti nitrides and carbonitrides may limit grain growth and favorably influence certain mechanical properties and weldability. However, this formation may be a disadvantage in the case of the method according to the invention, since Ti tends to hinder austenitization due to the formation of carbides, while TiN degrades the resilience. A maximum content of 0.5% is, therefore, not to be exceeded.

V and Zr are also elements capable of forming nitrides that degrade the resilience, so, in general, it is necessary that the sum Ti+V+Zr does not exceed 0.5%.

Its Al content is between traces and 0.2%.

Al is used as a deoxidizer during steelmaking. It is not necessary that an amount exceeding 0.2% remains in the steel after the deoxidation because there would be a risk of forming an excessive amount of AlN that would degrade the mechanical properties, and also of having difficulties in obtaining the martensitic microstructure.

Its O content is between traces and 0.04% (400 μm).

The requirements for the O content are those which are customary for martensitic stainless steels, as a function of the ability to form the steels without cracks starting from the inclusions and the quality of the mechanical properties sought for the final part, and which the excessive presence of oxidized inclusions is likely to alter. Conversely, if a minimum machinability of the sheet is desired, it may be advantageous to have a significant number of oxidized inclusions, if their composition makes them sufficiently malleable so that they serve as a lubricant for the cutting tool. This technique for controlling the number and composition of oxidized inclusions is customary in the iron and steel industry. The control of the composition of the oxides may be advantageously obtained by a controlled addition of Ca and/or an adjustment of the composition of the slag with which the liquid steel is in contact and in chemical equilibrium during the preparation.

It is essentially the addition of deoxidizers Al, Si, Ti, Zr during the steelmaking, the possible addition of Ca, the care then brought to the decantation of the oxidized inclusions within the liquid steel and the subsistence of these deoxidants in the solidified steel which determine the final content of O. While each of these elements, taken separately, may be absent or only very slightly present, it is nevertheless necessary that at least one of them (most often Al and/or Si) is present in an amount sufficient to ensure that the O content of the final sheet will not be too high for smooth shaping of the part, and for future applications of the part. These mechanisms governing the deoxidation of steels and the control of the composition and amount of their oxidized inclusions are well known to those skilled in the art, and apply in the context of the invention in a perfectly normal manner.

Its Nb content is between 0.05% and 1.0%

Its total Nb+Ta content is between 0.05% and 1.0%.

Nb and Ta are important elements for obtaining good resilience, while Ta improves resistance to corrosion through pitting. But since they may interfere with austenitization, they must not be present in quantities exceeding what has just been prescribed above. In addition, Nb and Ta capture carbonitrides formed by C and N, which prevents too much growth of the austenite grains during austenitization. This is favorable for obtaining a very good cold resilience, between −100° C. and 0° C. On the other hand, if the Nb and/or Ta content is too high, C and N will be completely trapped in the carbonitrides and they will not remain sufficiently dissolved in order to achieve the desired mechanical properties, in particular the resilience and the mechanical resistance.

Therefore $0.25 \leq (Nb+Ta)/(C+N) \leq 8$ is required to obtain a resilience of the order of 50 J/cm$^2$ at 20° C. or more.

Its V content is between traces and 0.3%.

Like Ti, V is an embrittling element that is likely to form nitrides, and should not be present in too large an amount. As stated above, Ti+V+Zr must not exceed 0.5%.

Its Co content is between traces and 0.5%. This element, like Cu, is likely to help with austenitization. But it is pointless to add more than 0.5%, because austenitization may be assisted by less expensive means.

The total contents of Cu, Ni and Co must be between trace amounts and 5.0%, in order not to leave too much residual austenite after the martensitic transformation, and in order not to degrade the weldability in applications that require it.

Its Sn content is between traces and 0.05% (500 ppm). This element is not desirable because it is detrimental to the weldability and the ability of the steel to be heat-transformed. The limit of 0.05% is a tolerance.

Its B content is between traces and 0.1%.

B is not obligatory, but its presence is advantageous for the hardenability and forgeability of austenite. It thus facilitates the shaping. Its addition, above 0.1% (1000 ppm) does not bring significant additional improvement.

Its Zr content is between traces and 0.5%, because it reduces the resilience and hinders austenitization. It is also re-stated that the total content of Ti+V+Zr must not exceed 0.5%.

Its H content is between traces and 5 ppm, preferably not more than 1 ppm. Excessive H content tends to embrittle martensite. It is therefore necessary to choose a method of producing the steel in the liquid state which can ensure this low presence of H. Typically, treatments are chosen to ensure thorough degassing of the liquid steel (by massive injection of argon in the liquid steel, a well-known method called "AOD", or by a passage under vacuum during which the steel is decarburized through a release of CO, a method known as "VOD").

Its N content is between traces and 0.2% (2000 ppm). N is an impurity the same treatments of which make it possible to reduce the H content, contribute to limiting its presence, or even substantially reducing it. It is not always necessary to have a particularly low N content, but for the reasons given above, it is necessary that its content, taken together with the contents of elements with which it can combine to form nitrides or carbonitrides, obeys the relation $8 \geq (Nb+Ta)/(C+N) \geq 0.25$.

In addition, good austenitization of the steel during the initial stage of the thermo-mechanical treatment is favored if one respects the relation $(Mn+Ni) \geq (Cr-10.3-80\times[(C+N)^2])$. Sufficient resilience is achieved if this condition is met in addition to the other conditions defined above. A sufficient level of gammagenic elements is needed to counterbalance the alphagenic effect of Cr and to ensure correct austenitization of at least 80%, while the efficiency of the sum C+N is not linear from this point of view.

Its Ca content is ≤0.002% (20 ppm).

Its total content of rare earths and Y is between traces and 0.06% (600 ppm). These elements can improve the resistance to oxidation during austenitizations at very high temperatures.

The rest of the steel consists of iron and impurities resulting from the steelmaking.

Other requirements for the composition of the steel relate to the martensitic transformation start temperature Ms and the end of the martensitic transformation Mf.

Ms should preferably be at most 400° C. If Ms is higher, there is a risk that the various transfer and shaping operations of the part do not succeed each other quickly enough, and that there is insufficient time to effect all the shaping at a temperature higher than Ms. However, this risk may be limited or avoided by providing for the part to undergo reheating or temperature maintenance between the shaping operations, and/or using known types of heated tools incorporating, for example, electrical resistors, during these operations. The condition Ms≤400° C. is therefore not always imperative, but only recommended for an economical and easy application of the method according to the invention under industrial conditions.

Ms must be greater than or equal to 200° C. to avoid the subsistence of too high a residual austenite content in the final part, which in particular would degrade Rp0,2 by lowering it below 800 MPa.

Preferably, Ms is from 390 to 320° C.

Mf must be greater than or equal to −50° C. to ensure that there will not be too much residual austenite in the final part.

Ms and Mf are preferably determined experimentally, for example, by the well-known dilatometric measurements; see, for example, the article "Uncertainties in dilatometric determination of martensite start temperature", Yang and Badeshia, Materials Science and Technology, 2007/5, pp 556-560.

Approximate formulas also make it possible to evaluate them from the composition of the steel, but an experimental determination is more certain.

It should be understood that the thermo-mechanical treatments to be described may be carried out either on a bare sheet to be optionally subsequently coated, or on an already coated sheet, for example, by an alloy based on Al and/or or Zn. This coating, typically with a thickness of 1 to 200 μm and present on one or both sides of the sheet, may have been deposited by any technique conventionally used for this purpose, it is simply necessary that, if deposited before austenitization, it does not evaporate during the presence of the sheet at austenitization and deformation temperatures, and does not deteriorate during deformation.

The choice and the optimization of the characteristics of the coating and its mode of deposition for these conditions to be fulfilled do not go beyond what those skilled in the art know when they shape conventional coated stainless steel sheets. If the coating takes place prior to austenitization, Al-based coatings may be favored over those based on Zn, as Al is less likely than Zn to evaporate at austenitization temperatures.

The method according to the invention is as follows, applied to the manufacture and forming of a sheet.

In a first step, a bare or coated initial stainless steel sheet is conventionally prepared with the composition described above and a thickness which is typically 0.1 to 10 mm. This preparation may include hot and/or cold transformation and cutting operations on the semi-product resulting from the casting and solidification of the liquid steel. This initial sheet must have a microstructure consisting of ferrite and/or tempered martensite and 0.5% to 5% by volume of carbides. The size of the ferritic grains, measured according to the standard NF EN ISO 643, is between 1 and 80 μm, preferably between 5 and 40 μm. A ferritic grain size of 40 μm or less is recommended in order to promote the austenitization to follow in order to thus obtain the desired 80% or more of austenite. A ferritic grain size of at least 5 μm is recommended to obtain good cold shaping capacity.

The sheet is first austenitized by passing through a furnace at a temperature range greater than Ac1 (start temperature of the appearance of austenite), and, therefore, typically greater than about 850° C. for the compositions concerned). It should be understood that this austenitization temperature must concern the entire volume of the sheet, and that the treatment must be sufficiently long so that, given the thickness of the sheet and the kinetics of the transformation, the austenitization is completed throughout this volume.

The maximum temperature of this austenitization is not a specific feature of the invention. It must simply be such that the sheet remains in a completely solid state (the temperature must therefore be lower, in any case, at the solidus temperature of the steel) and is not too softened in order to withstand without damage the transfer between the oven and the shaping tool that will follow the austenitization. In addition, the temperature should not be so high as to cause substantial surface oxidation and/or decarburization of the sheet in the heating atmosphere. Superficial oxidation would lead to the necessity of descaling the sheet mechanically or chemically before it is shaped to avoid scale incrustation on the surface of the sheet, and that would lead to a loss of material. Excessive decarburization (thickness of the decarburized surface≥100 μm) would reduce the hardness and tensile strength of the sheet. The risks of observing significant oxidation and/or decarburization depend, in a known manner, not only on the temperature and duration of austenitization, but also on the furnace treatment atmosphere. A non-oxidizing, therefore neutral or reducing, atmosphere (typically: argon, CO and their mixtures, etc.), preferably to air, makes it possible to increase the treatment temperature without damage, which makes it possible to ensure complete austenitization in a minimum of time. If pure nitrogen or a highly hydrogenated atmosphere is used in a furnace requiring high residence time for austenitization, there is a risk of superficial nitriding or uptake of hydrogen by the steel. This must be taken into account in the choice of the treatment atmosphere, and atmospheres of pure nitrogen or those containing a relatively high hydrogen content, are sometimes to be avoided.

Typically, the austenitization takes place at a temperature of between 925 and 1200° C. for a period of 10 s to 1 h (this period being when the sheet increases over Ac1), preferably between 2 min and 10 min for heating in a conventional oven and between 30 s and 1 min for heating in an induction furnace. An induction furnace has the advantage, known in itself, of providing rapid heating up to the nominal austenitization temperature. It allows for a shorter treatment than a conventional oven in order to achieve the desired result. These temperatures and periods make it possible to ensure that the rest of the treatments will lead to a sufficient formation of martensite within a reasonable period, allowing good productivity to the use of the method.

The purpose of this austenitization is to pass the metal of the initial ferrite+carbides structure to an austenitic structure containing at most 0.5% of carbides in volume fraction, and at most 20% of residual ferrite in volume fraction. One aim of this austenitization is, in particular, to lead to a dissolution of at least the majority of the carbides initially present in order to release C atoms to form the austenitic structure and then the martensitic structure in the subsequent steps of the method. The maximum residual ferrite content of 20%, which must be sustained until the final product, is justified by the resilience and the conventional yield strength to be obtained.

The austenitized sheet is then transferred to a suitable forming tool (such as a stamping or drawing tool) or a cutting tool. This transfer has a duration t0 as short as possible and the sheet must remain at a temperature higher than Ms during this transfer, while maintaining an austenitic microstructure with a maximum of 0.5% of carbides and a maximum of 20% of residual ferrite. After this transfer, the sheet is at a temperature TP0, which is as close as possible to the nominal austenitization temperature for obvious reasons of energy saving.

A first step of shaping or cutting is then performed for a duration t1, typically between 0.1 and 10 s. The precise duration of this step (like those of the other steps) is not in itself a fundamental characteristic of the invention. It must be sufficiently short so that the temperature of the sheet does not fall below Ms, and so that there is not significant decarburization and/or oxidation of the surface of the sheet, and so that an austenitic microstructure with a maximum of 0.5% of carbides and a maximum of 20% of residual ferrite is always present at the end of the operation. If necessary, it is possible to use a shaping tool provided with means for heating the sheet so that these temperature and microstructure conditions are maintained, since the contact of a non-heated shaping tool with the sheet causes cooling of the sheet which is often greater than 100° C./s.

The absence of significant surface decarburization and oxidation may be achieved by adjusting the composition of the steel if necessary in the light of experience and, if possible, by maintaining a neutral or reducing atmosphere around the sheet during its shaping.

All these conditions relating to the shaping temperature and its evolution, and the atmosphere surrounding the sheet during its shaping, are also valid for the following shaping steps.

The sheet thus shaped is then transferred to another tool for a second shaping step in the broad sense of the term. Alternatively, the same tool may be used in both steps by changing its configuration in the interval (for example by replacing the punch when there is drawing in each of the two steps). The duration t2 for this transfer is typically from 1 to 10 s, the aim being that it should be fast enough for the sheet temperature to remain higher than Ms during the transfer and that the microstructure should remain austenitic with a maximum of 0.5% of carbides and 20% maximum of residual ferrite.

The second shaping step with a duration t3 typically between 0.1 and 10 s, is then performed. The temperature of the sheet remains higher than Ms while the microstructure remains austenitic, with a maximum of 0.5% of carbides and a maximum of 20% of residual ferrite.

Other forming steps (in the broad sense defined above), and their corresponding transfers, may follow this second shaping step.

The essential thing is that during the execution of these transfers and the shaping/cutting, the temperature of the steel does not fall below Ms, and that a austenitic microstructure with a 0.5% maximum of carbides and 20% maximum of residual ferrite is retained until the end of the final step n at the final temperature TPn. If necessary, as mentioned above, heated shaping tools may be used, as well as means for reheating the sheet between shaping operations.

The average cooling rate between TP0 and TPn, defined by the quantity (TP0−TPn)/Σti where Σti constitutes the sum of the periods of the transfers and the shaping, must be at least 0.5° C./s.

The consequence of this cooling rate between the beginning and the end of the shaping operations which have just been described, combined with the composition of the steel and the procedure used during shaping, is that during the cooling, the steel does not enter the "nose" of the TRC diagram which corresponds to the bainitic transformation, but remains in the austenitic domain before going directly into the domain where the martensitic transformation may take place. The composition of the steel is precisely chosen so that, compared to the carbon steels that are most commonly used in the automotive industry for the production of sheets capable of being welded, this nose is displaced towards the higher periods, thus making it possible to avoid the bainitic domain on the usual shaping tools, a fortiori the ferritic and pearlitic domains, and, therefore, to obtain as complete as possible a transformation of austenite into martensite. But it should be remembered that, as has been said, each step taken individually must allow an austenitic microstructure with a 0.5% maximum of carbides and a 20% maximum of residual ferrite to be maintained. The duration/cooling rate pair of each step must therefore be chosen accordingly, and, if necessary, reheating of the sheet between and/or during shaping or cutting has to be performed so that this microstructure may be maintained during all steps.

It is optionally possible to carry out at least one further step of shaping in the broad sense at a temperature between Ms and Mf, in a domain where the microstructure comprises at least 5% by volume of austenite. If this additional step involves cutting, the final shape of the part may be achieved with less wear of the tools, and if this additional step involves deformation, at least 5% of austenite will provide sufficient ductility for this deformation to be possible despite the sometimes significant presence of martensite.

Finally the sheet is allowed to cool, for example in the open air, to ambient temperature, thus obtaining the final part according to the method of the invention. It is not necessary to impose a minimum speed during this cooling, because the composition of the steel ensures that the sheet will remain anyway in the domain in which the martensitic transformation may take place while cooling to ambient temperature, at least if no means are used which substantially slow down the cooling compared with natural cooling in the open air, such as an enclosure of the sheet. Of course, this cooling may be accelerated by means of forced air or a projection of water or of another fluid.

The possibility of using at least two steps to obtain the final shape of the part gives access, thanks to the use of a steel having the composition specified and treated according to the invention, to complex shapes for the final part that cannot be achieved with known methods using only a single shaping of the original sheet, in any event not with sufficient quality.

Optionally, surface treatment may be applied to the final part such as blasting or sanding, in order to increase the roughness of its surface and so improve the adhesion of a coating to be subsequently applied, such as paint, or to create residual stresses that improve the fatigue strength of the sheet. This type of operation is known in itself.

In addition, a final heat treatment may be performed on the final part after cooling to ambient temperature in order to improve its elongation at break and bring it to a value of more than 8% according to ISO standards, which corresponds to substantially more than 10% according to JIS standards. This treatment consists in making the final part remain between 90 and 500° C. for 10 s to 1 h, then to carry out natural cooling in the air.

The part thus obtained by the method according to the invention has high mechanical properties at ambient temperature, in particular because of its high martensite content of at least 80%. Typically, Rm is at least 1000 MPa, Re at least 800 MPa, elongation at break A measured according to ISO 6892 is at least 8%, while the folding angle capability for a 1.5 mm thickness is at least 60°, measured according to VDA 238-100.

FIG. 1 schematically represents an exemplary operating diagram for a method according to the invention carried out on a steel with a composition in accordance with that of Example 2 of Table 1 which follows, wherein Ms is 380° C. and Mf 200° C., and comprising the following steps:

- heating the 1.5 mm thick sheet 2 in a conventional roller oven 1 for 2 min, between ambient temperature and a TPi temperature equal to 950° C.;
- keeping the sheet 2 in the oven 1 at the temperature TPi for a time tm of 3 min;
- transfer of the sheet 2 between the furnace 1 and a hot drawing tool 3 for a duration t0 of 1 s; wherein the temperature of the steel decreases to TP0=941° C.;
- first shaping (deformation) step, performed in the hot drawing tool 3 for a time t1 of 0.5 s in order to obtain a shaped sheet 4; wherein the temperature of the steel decreases to TP1=808° C.;
- transfer of the shaped sheet 4 between the hot drawing tool 3 and a drilling tool 5 for a period t2 of 0.5 s; wherein the temperature of the steel decreases to TP2=799° C.;
- second shaping step, consisting of a drilling performed in the drilling tool 5 for a period t3 of 1 s to obtain a shaped and drilled sheet 6; wherein the temperature of the steel decreases to TP3=667° C.;
- transfer of the shaped and drilled sheet 6 to a cutting tool 7 to cut the edges of the sheet 6 in order to give them their final dimensions and obtain the product 8;
- shot blasting of the product 8 in a shot blaster 9 in order to optimize its resistance to fatigue or the adhesion of a possible layer of future coating.

Figure 2:
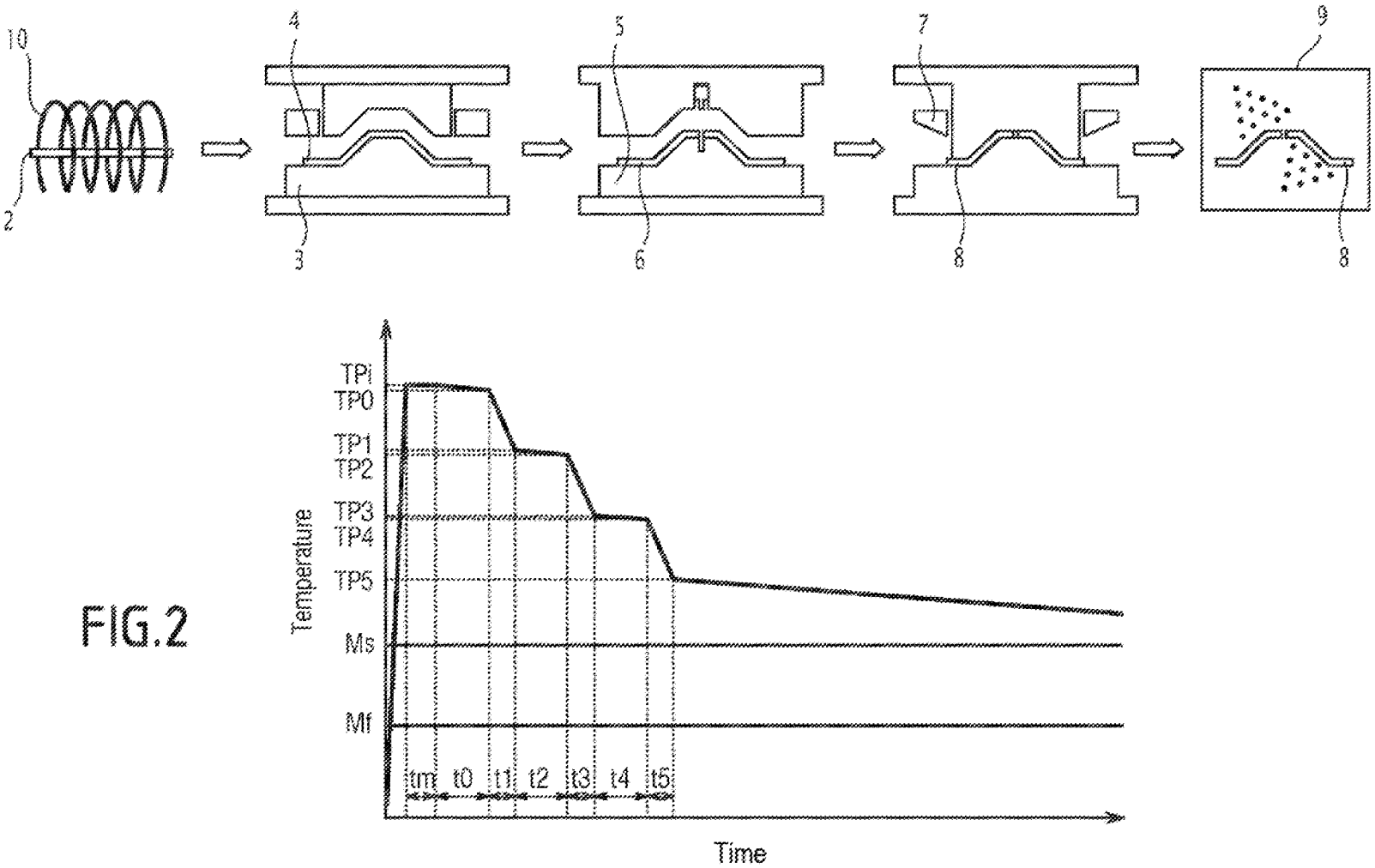
FIG. 2 shows a diagram representing the manufacture of a part making use of the method according to the invention, using an induction furnace, and the development of the temperature of the steel during manufacture.

FIG. 2 schematically represents another example of an operating diagram for a method according to the invention, performed on a sheet 2 of a steel with a composition in accordance with that of Example 7 of Table 1 below, wherein Ms is 380° C. and Ms 200° C., and comprising the following steps:

- heating in a conventional induction furnace for 20 seconds with a sheet 2 that is 1.5 mm thick, between ambient temperature and a temperature TPi=950° C.;
- keeping the sheet 2 in the induction furnace 10 at the temperature TPi for a period tm of 30 s;
- transfer of the sheet 2 between the induction furnace 10 and a hot drawing tool 3 for a period t0 of 1 s; wherein the temperature of the steel decreases to TP0=941° C.;
- first forming (deformation) step, performed in the hot drawing tool 3 for a time t1 of 0.5 s to obtain a shaped sheet 4; wherein the temperature of the steel decreases to TP1=808° C.;
- transfer of the shaped sheet 4 between the hot drawing tool 3 and a drilling tool 5 for a duration t2 of 1 s; wherein the temperature of the steel decreases to TP2=799° C.;
- second forming step, consisting of a drilling performed in the drilling tool 5 for a period t3 of 0.5 s to obtain a shaped and drilled sheet 6; wherein the temperature of the steel decreases to TP3=667° C.;
- transfer of the shaped and drilled sheet 6 to a cutting tool 7 for a period t4 of 1 s, in order to cut the edges of the sheet 6; wherein the temperature of the sheet decreases to TP4=658° C.;
- third forming step consisting of cutting the edges of the part 6 to give it its final dimensions and to obtain the product 8, for a period t5 of 0.5 s; wherein the temperature of the part decreases to TP5=525° C.;
- shot blasting 9 of the product 8 to optimize its resistance to fatigue or adhesion of a possible future coating layer.

The methods of FIG. 1 and FIG. 2 therefore do not differ fundamentally. The only difference is that the induction furnace 10 allows faster heating and a more regular speed than the conventional roller oven 1. The heating time and the maintenance period tm are therefore shortened, which is advantageous for the productivity of the installation. Induction heating also more assuredly ensures homogeneity of the temperature of the sheet throughout its volume, which is advantageous for the carrying out of the shaping steps and obtaining the final targeted properties.

Table 1 which follows shows the compositions of examples of steels to which the method according to the invention as described above and shown in FIG. 1, has been applied. The elements not mentioned are present only as traces resulting from the steelmaking.

TABLE 1

Compositions of test samples

| | Ex. | C % | Mn % | P % | S ppm | Si % | Al % | Ni % | Cr % | Cu % | Mo % | W % | Sn ppm | Nb % | Ta % | V % | Ti % |
|---|---|---|---|---|---|---|---|---|---|---|---|---|---|---|---|---|---|
| Invention | 1 | 0.102 | 0.35 | 0.022 | 6 | 0.40 | 0.002 | 0.093 | 12.0 | 0.044 | 0.01 | 0.007 | 2 | 0.11 | traces | 0.10 | 0.007 |
| | 2 | 0.06 | 0.51 | 0.019 | 40 | 0.38 | 0.002 | 0.41 | 11.2 | traces | traces | traces | 1 | 0.10 | traces | traces | traces |
| | 3 | 0.06 | 0.51 | 0.019 | 40 | 0.38 | 0.002 | 0.41 | 11.2 | 0.600 | traces | traces | 1 | 0.10 | traces | Traces | traces |
| | 4 | 0.055 | 0.40 | 0.020 | 40 | 0.42 | 0.002 | 0.35 | 11.3 | 0.030 | 0.20 | 0.10 | 1 | 0.05 | 0.10 | 0.10 | 0.005 |
| | 5 | 0.055 | 0.40 | 0.020 | 40 | 0.42 | 0.002 | 0.35 | 11.3 | 0.030 | 0.20 | 0.50 | 1 | 0.10 | traces | 0.10 | 0.005 |
| | 6 | 0.006 | 1.14 | 0.016 | 9 | 0.38 | 0.030 | 0.88 | 12.0 | 0.011 | 0.001 | traces | 10 | 0.11 | traces | 0.027 | 0.077 |
| | 7 | 0.14 | 0.45 | 0.020 | 5 | 0.35 | 0.001 | 0.40 | 11.1 | 0.091 | 0.027 | traces | 320 | 0.14 | traces | traces | 0.004 |
| | 8 | 0.10 | 0.30 | 0.020 | 10 | 0.40 | 0.002 | 3.0 | 12.0 | 0.020 | 1.90 | traces | 50 | 0.10 | traces | 0.08 | 0.004 |
| | 9 | 0.10 | 0.30 | 0.020 | 10 | 0.40 | 0.002 | 2.5 | 12.0 | 0.020 | 1.65 | traces | 50 | 0.10 | traces | 0.08 | 0.004 |
| | 10 | 0.10 | 0.30 | 0.020 | 10 | 0.40 | 0.002 | 2.5 | 12.0 | 0.020 | 1.65 | traces | 50 | 0.10 | 0.50 | 0.08 | 0.004 |
| | 11 | 0.10 | 0.30 | 0.020 | 10 | 0.40 | 0.002 | 2.0 | 12.0 | 0.020 | 1.35 | traces | 50 | 0.10 | traces | 0.08 | 0.004 |
| | 12 | 0.10 | 0.30 | 0.020 | 10 | 0.40 | 0.002 | 2.0 | 15.0 | 0.020 | 1.35 | traces | 50 | 0.10 | traces | 0.08 | 0.004 |
| | 13 | 0.10 | 0.30 | 0.020 | 10 | 0.40 | 0.002 | 1.5 | 12.0 | 0.020 | 1.05 | traces | 50 | 0.10 | traces | 0.08 | 0.004 |
| References | 14 | 0.10 | 0.30 | 0.020 | 10 | 0.40 | 0.002 | 1.5 | 12.0 | 0.020 | 1.05 | 0.60 | 50 | 0.10 | traces | 0.08 | 0.004 |
| | 15 | 0.102 | 0.35 | 0.022 | 6 | 0.40 | 0.002 | 0.09 | 12.0 | 0.044 | 0.01 | 0.007 | 2 | 0.11 | traces | 0.10 | 0.007 |
| | 16 | 0.055 | 0.40 | 0.020 | 40 | 0.42 | 0.002 | 0.35 | 11.3 | 0.030 | 0.20 | 0.007 | 1 | 0.02 | 0.0002 | 0.10 | 0.50 |
| | 17 | 0.395 | 0.34 | 0.027 | 18 | 0.28 | 0.002 | 0.19 | 14.1 | 0.044 | 0.63 | traces | 2 | 0.001 | 0.001 | 0.001 | 0.001 |
| | 18 | 0.41 | 0.20 | 0.027 | 18 | 0.28 | 0.002 | 0.30 | 13.9 | 0.050 | 0.70 | traces | 2 | 0.001 | 0.001 | 0.001 | 0.001 |
| | 19 | 0.125 | 0.41 | 0.033 | 10 | 0.36 | 0.001 | 0.29 | 12.32 | 0.110 | 0.02 | traces | traces | 0.006 | traces | 0.08 | 0.009 |
| | 20 | 0.23 | 1.16 | 0.017 | 6 | 0.28 | 0.057 | 0.025 | 0.17 | 0.025 | 0.006 | traces | 1 | 0.001 | traces | 0.004 | 0.04 |
| | 21 | 0.23 | 0.37 | 0.024 | 10 | 0.51 | traces | 0.15 | 13.2 | 0.080 | 0.014 | traces | traces | 0.005 | traces | 0.077 | 0.004 |
| | 22 | 0.461 | 0.33 | 0.024 | 19 | 0.33 | traces | 0.094 | 13.7 | 0.080 | 0.011 | traces | traces | 0.005 | traces | 0.077 | 0.004 |
| | 23 | 0.345 | 0.377 | 0.024 | 15 | 0.29 | traces | 0.52 | 16.2 | 0.091 | 0.027 | traces | traces | 0.005 | traces | 0.077 | 0.004 |
| | 24 | 0.107 | 0.59 | 0.020 | 20 | 0.56 | 0.001 | 0.38 | 11.4 | 0.091 | 0.027 | traces | 90 | 0.006 | traces | 0.077 | 0.001 |
| | 25 | 0.009 | 0.20 | 0.030 | 100 | 0.55 | 0.030 | 0.20 | 11.1 | 0.300 | 0.30 | traces | 500 | 0.001 | traces | traces | 0.175 |
| | 26 | 0.033 | 0.30 | 0.018 | 17 | 0.27 | traces | 0.12 | 16.1 | 0.023 | 0.004 | traces | 40 | 0.48 | traces | 0.08 | 0.007 |
| | 27 | 0.009 | 0.25 | 0.018 | 17 | 0.58 | traces | 0.12 | 14.8 | 0.023 | 0.004 | traces | 40 | 0.48 | traces | 0.08 | 0.007 |
| | 28 | 0.021 | 0.41 | 0.021 | 30 | 0.16 | 0.002 | 1.4 | 16.8 | 0.050 | 0.15 | traces | 20 | 0.003 | traces | 0.12 | 0.005 |
| | 29 | 0.015 | 0.313 | 0.029 | 11 | 0.42 | 0.004 | 0.20 | 16.5 | 0.120 | 0.024 | traces | 67 | 0.15 | traces | 0.11 | 0.106 |
| | 30 | 0.05 | 0.35 | 0.021 | 80 | 0.30 | 0.0006 | 0.12 | 12.6 | 0.031 | 0.01 | traces | 50 | 0.003 | traces | 0.097 | 0.007 |
| | 31 | 0.0463 | 0.914 | 0.019 | 14 | 0.37 | 0.012 | 1.61 | 13.9 | 0.073 | 0.027 | traces | 54 | 0.006 | traces | 0.108 | 0.362 |
| | 32 | 0.10 | 0.30 | 0.020 | 10 | 0.40 | 0.002 | 3.1 | 12.0 | 1.50 | 1.90 | traces | 50 | 0.10 | traces | 0.08 | 0.004 |
| | 33 | 0.10 | 0.30 | 0.020 | 10 | 0.40 | 0.002 | 2.5 | 12.0 | 0.020 | 1.65 | traces | 50 | 0.50 | 0.70 | 0.08 | 0.004 |

| | Ex. | Zr % | Co % | B ppm | N ppm | H ppm | O ppm | Ca ppm | Y ppm | (Mn + Ni) − [Cr − 10.3 − 80 (C + N)$^2$] % | Cu + Ni + Co % | Mo + 2 × W % | (Nb + Ta)/(C + N) | Nb + Ta % | Ti + Zr + V % |
|---|---|---|---|---|---|---|---|---|---|---|---|---|---|---|---|
| Invention | 1 | 0.005 | 0.019 | 4 | 250 | 0.2 | 10 | 5 | 0.1 | 0.03 | 0.156 | 0.024 | 0.835 | 0.106 | 0.112 |
| | 2 | traces | 0.036 | traces | 100 | <0.1 | 10 | 5 | 0.1 | 0.41 | 0.446 | traces | 1.4289 | 0.100 | traces |
| | 3 | traces | 0.036 | traces | 100 | <0.1 | 10 | 5 | 0.1 | 0.41 | 1.046 | traces | 1.429 | 0.100 | traces |
| | 4 | 0.002 | 0.036 | traces | 110 | <0.1 | 10 | 5 | 0.1 | 0.10 | 0.416 | 0.400 | 2.273 | 0.150 | 0.107 |
| | 5 | 0.002 | 0.036 | traces | 110 | <0.1 | 10 | 5 | 0.1 | 0.10 | 0.416 | 1.200 | 1.515 | 0.100 | 0.107 |
| | 6 | traces | 0.021 | traces | 110 | 0.2 | 10 | 5 | 0.1 | 0.38 | 0.912 | 0.001 | 6.471 | 0.110 | 0.104 |
| | 7 | traces | 0.037 | traces | 500 | 0.2 | 10 | 5 | 0.1 | 2.93 | 0.528 | 0.027 | 0.737 | 0.140 | 0.004 |
| | 8 | traces | 0.050 | traces | 1000 | 0.2 | 10 | 5 | 0.1 | 4.80 | 3.070 | 1.900 | 0.500 | 0.100 | 0.084 |
| | 9 | traces | 0.050 | traces | 1000 | 0.2 | 10 | 5 | 0.1 | 4.30 | 2.570 | 1.650 | 0.500 | 0.100 | 0.084 |
| | 10 | traces | 0.050 | traces | 1000 | 0.2 | 10 | 5 | 0.1 | 4.30 | 2.570 | 1.650 | 3.000 | 0.600 | 0.084 |
| | 11 | traces | 0.050 | traces | 1000 | 0.2 | 10 | 5 | 0.1 | 3.80 | 2.070 | 1.350 | 0.500 | 0.100 | 0.084 |
| | 12 | traces | 0.050 | traces | 1000 | 0.2 | 10 | 5 | 0.1 | 0.80 | 2.070 | 1.350 | 0.500 | 0.100 | 0.084 |
| | 13 | traces | 0.050 | traces | 1000 | 0.2 | 10 | 5 | 0.1 | 3.30 | 1.570 | 1.050 | 0.500 | 0.100 | 0.084 |
| References | 14 | traces | 0.050 | traces | 1000 | 0.2 | 10 | 5 | 0.1 | 3.30 | 1.570 | 2.250 | 0.500 | 0.100 | 0.084 |
| | 15 | 0.005 | 0.019 | 4 | 250 | 10 | 10 | 5 | 0.1 | 0.03 | 0.156 | 0.024 | 0.835 | 0.106 | 0.112 |
| | 16 | 0.05 | 0.036 | traces | 110 | <0.1 | 10 | 5 | 0.1 | 0.10 | 0.416 | 0.400 | 0.306 | 0.020 | 0.650 |
| | 17 | 0.001 | traces | 4 | 900 | 0.2 | 10 | 5 | 0.1 | 15.56 | 0.234 | 0.644 | 0.004 | 0.002 | 0.003 |
| | 18 | 0.001 | traces | 4 | 900 | 0.2 | 10 | 5 | 0.1 | 16.90 | 0.350 | 0.714 | 0.004 | 0.002 | 0.003 |
| | 19 | traces | 0.020 | traces | 270 | 0.2 | 18 | 5 | 0.1 | 0.53 | 0.420 | 0.020 | 0.039 | 0.006 | 0.089 |
| | 20 | traces | 0.008 | 2 | 37 | 0.2 | 10 | 5 | 0.1 | 15.68 | 0.058 | 0.006 | 0.004 | 0.001 | 0.044 |
| | 21 | traces | 0.020 | traces | 200 | 0.2 | 10 | 5 | 0.1 | 2.62 | 0.250 | 0.014 | 0.020 | 0.005 | 0.081 |
| | 22 | traces | 0.020 | traces | 298 | 0.2 | 10 | 5 | 0.1 | 16.27 | 0.194 | 0.011 | 0.010 | 0.005 | 0.081 |
| | 23 | traces | 0.020 | traces | 1600 | 0.2 | 10 | 5 | 0.1 | 15.40 | 0.634 | 0.027 | 0.010 | 0.005 | 0.081 |
| | 24 | traces | 0.020 | 3 | 140 | 0.2 | 10 | 5 | 0.1 | −0.10 | 0.491 | 0.027 | 0.193 | 0.006 | 0.079 |
| | 25 | traces | 0.020 | traces | 180 | 0.2 | 10 | 5 | 0.1 | −0.34 | 0.520 | 0.300 | 0.037 | 0.001 | 0.175 |
| | 26 | traces | 0.018 | traces | 400 | 0.2 | 10 | 5 | 0.1 | −5.00 | 0.161 | 0.004 | 6.575 | 0.480 | 0.087 |
| | 27 | traces | 0.018 | traces | 186 | 0.2 | 10 | 5 | 0.1 | −4.09 | 0.161 | 0.004 | 17.391 | 0.480 | 0.087 |
| | 28 | traces | 0.046 | traces | 270 | 0.2 | 10 | 5 | 0.1 | −4.49 | 1.496 | 0.150 | 0.062 | 0.003 | 0.125 |
| | 29 | traces | 0.026 | 5 | 244 | 0.2 | 10 | 5 | 0.1 | −5.68 | 0.346 | 0.024 | 6.254 | 0.153 | 0.216 |
| | 30 | traces | 0.016 | 2 | 200 | 0.2 | 10 | 5 | 0.1 | −1.47 | 0.167 | 0.010 | 0.043 | 0.003 | 0.104 |

TABLE 1-continued

| Compositions of test samples | | | | | | | | | | | | | | |
|---|---|---|---|---|---|---|---|---|---|---|---|---|---|---|
| 31 | traces | 0.052 | 2 | 99 | 0.2 | 10 | 5 | 0.1 | −0.87 | 1.732 | 0.274 | 0.114 | 0.006 | 0.470 |
| 32 | traces | 0.50 | traces | 1000 | 0.2 | 10 | 5 | 0.1 | 4.90 | 5.100 | 1.900 | 0.500 | 0.100 | 0.084 |
| 33 | traces | 0.050 | traces | 1000 | 0.2 | 10 | 5 | 0.1 | 4.30 | 2.570 | 1.650 | 6.000 | 1.200 | 0.084 |

Table 2 shows the intermediate metallurgical structures (during the processing stages where the temperature of the steel is above Ms) and final metallurgical structures of these same examples with the mechanical properties of the final part: tensile strength Rm, elastic limit Rp0,2, elongation A, KCU resilience, folding angle capability. In the columns relating to the intermediate structure, MC designates the proportion of carbides.

The invention also includes cases where a sheet having the composition required by the invention is secured to a sheet having another composition, and wherein the assembly thus obtained is shaped by the method which has just been described. Of course, the structures and properties according to the invention will normally be obtained only on the part of the assembly having the composition of the invention.

TABLE 2

| Intermediate and final metallurgical structures and final mechanical properties of the examples in table 1 | | | | |
|---|---|---|---|---|
| | | | Final part | |
| | Ex. | Intermediate metallurgical structure | Final metallurgical structure | Rm (MPa)/ Rp0.2 (MPa)/ A (%) | KCU ($J/cm^2$)/folding angle (°) |
| Invention | 1 | MC = 0.1%; ferrite = 17% | Martensite = 82.90% | 1170/810/8.2 | 65/80 |
| | 2 | MC = 0.02%; ferrite = 3% | Martensite = 96.98% | 1130/850/9.4 | 75/100 |
| | 3 | MC = 0.02%; ferrite = 1% | Martensite = 98.98% | 1150/870/9.3 | 80/110 |
| | 4 | MC = 0.02%; ferrite = 5% | Martensite = 94.98% | 1145/840/9.1 | 75/110 |
| | 5 | MC = 0.02%; ferrite = 6% | Martensite = 93.98% | 1180/870/9.0 | 65/90 |
| | 6 | MC = 0.12%; ferrite = 19% | Martensite = 80.88% | 1175/810/9.7 | 70/80 |
| | 7 | MC = 0.05%; ferrite = 1% | Martensite = 98.95% | 1550/1150/8.4 | 55/70 |
| | 8 | MC = 0.05%; ferrite = 0% | Martensite = 88% | 1570/1100/9.1 | 55/65 |
| | 9 | MC = 0.05%; ferrite = 0% | Martensite = 95% | 1560/1110/9.0 | 55/70 |
| | 10 | MC = 0.05%; ferrite = 0% | Martensite = 93% | 1550/1130/9.3 | 60/80 |
| | 11 | MC = 0.05%; ferrite = 0% | Martensite = 97% | 1500/1050/9.5 | 70/80 |
| | 12 | MC = 0.1%; ferrite = 0% | Martensite = 84% | 1600/1200/8.5 | 60/70 |
| | 13 | MC = 0.05%; ferrite = 0% | Martensite = 95% | 1510/1110/9.2 | 65/75 |
| Refereces | 14 | MC = 0.05%; ferrite = 0% | Martensite = 98% | 1200/810/8.1 | 30/55 |
| | 15 | MC = 0.05%; ferrite = 15% | Martensite = 84.95% | 1210/820/8.3 | 10/50 |
| | 16 | MC = 0.01%; ferrite = 80% | Martensite = 19.99% | 1010/700/10.5 | 60/70 |
| | 17 | MC = 0.35%; ferrite = 0% | Martensite = 75% | 1600/1000/4 | 30/10 |
| | 18 | MC = 0.40%; ferrite = 0% | Martensite = 72% | 1620/1010/4.2 | 30/15 |
| | 19 | MC = 0.05%; ferrite = 15% | Martensite = 84.95% | 1230/900/9.0 | 25/70 |
| | 20 | MC = 0%; ferrite = 0% | Martensite = 100% | 1500/1050/4.5 | 70/45 |
| | 21 | MC = 0.1%; ferrite = 5% | Martensite = 94.90% | 1800/1100/7.5 | 30/50 |
| | 22 | MC = 1%; ferrite = 0% | Martensite = 70% | 1700/1000/3.2 | 20/15 |
| | 23 | MC = 1%; ferrite = 0% | Martensite = 73% | 1750/1050/3 | 25/10 |
| | 24 | MC = 0.01%; ferrite = 15% | Martensite = 84.99% | 950/720/6 | 90/130 |
| | 25 | MC = 0.01%; ferrite = 95% | Martensite = 4.99% | 460/320/27 | 80/130 |
| | 26 | MC = 0.01%; ferrite = 80% | Martensite = 19.99% | 750/520/12 | 50/110 |
| | 27 | MC = 0.01%; ferrite = 99.99% | Martensite = 0% | 540/350/29 | 80/130 |
| | 28 | MC = 0.005%; ferrite = 99.995% | Martensite = 0% | 800/700/13 | 60/120 |
| | 29 | MC = 0.003%; ferrite = 99.997% | Martensite = 0% | 500/350/20 | 65/120 |
| | 30 | MC = 0.01%; ferrite = 18% | Martensite = 81.99% | 1000/780/8.5 | 20/105 |
| | 31 | MC = 0.01%; ferrite = 45% | Martensite = 54.99% | 850/650/5 | 40/90 |
| | 32 | MC = 0.05%; ferrite = 25% | Martensite = 74.95% | 1600/1050/8.5 | 35/65 |
| | 33 | MC = 0.05%; ferrite = 65% | Martensite = 34.95% | 900/700/12 | 60/110 |

It can be seen from this table that the examples according to the invention are the only ones which make it possible to achieve all the targeted objectives in terms of mechanical properties.

Of course, if a preferred application of the invention is the shaping of sheets for the automotive industry, this application is not exclusive, and the sheets thus shaped may be designed for any other application for which they are advantageous, especially any structural function parts, e.g. aeronautics, building, railway.

The invention claimed is:

1. A method of manufacturing a martensitic stainless steel part from a sheet by hot forming, wherein:

a stainless steel sheet with the following composition in percentages by weight is prepared:

$0.005\% \leq C \leq 0.3\%$;

$0.2\% \leq Mn \leq 2.0\%$;

$traces \leq Si \leq 1.0\%$;

$traces \leq S \leq 0.01\%$;

$traces \leq P \leq 0.04\%$;

$10.5\% \leq Cr \leq 17.0\%$;

traces≤Ni≤4.0%;
traces≤Mo≤2.0%;
Mo+2×W≤2.0%;
traces≤Cu≤3%;
traces≤Ti≤0.5%;
traces≤Al≤0.2%;
traces≤O≤0.04%;
0.05%≤Nb≤1.0%;
0.05%≤Nb+Ta≤1.0%;
0.25%≤(Nb+Ta)/(C+N)≤8;
traces≤V≤0.3%;
traces≤Co≤0.5%;
traces≤Cu+Ni+Co≤5.0%;
traces≤Sn≤0.05%;
traces≤B≤0.1%;
traces≤Zr≤0.5%;
Ti+V+Zr≤0.5%;
traces≤H≤5 ppm;
traces≤N≤0.2%;
(Mn+Ni)≥(Cr−10.3−80×[(C+N)$^2$]);
traces≤Ca≤0.002%;
traces≤rare earths and/or Y≤0.06%;

the rest being iron and impurities resulting from steelmaking;

the martensitic transformation start temperature (Ms) of the sheet is ≥200° C.;

the martensitic transformation end temperature (Mf) of the sheet is ≥−50° C.;

the microstructure of the sheet is composed of ferrite and/or tempered martensite and 0.5% to 5% by volume of carbides;

the size of the ferritic grains of the sheet is from 1 to 80 μm;

the sheet is austenitized by maintaining it at a temperature greater than Ac1, in order to give it a microstructure containing at most 0.5% of carbides in volume fraction and at most 20% of residual ferrite in volume fraction;

the austenitized sheet is transferred to a first shaping tool or a cutting tool, wherein the transfer has a duration t0, during which the sheet remains at a temperature greater than Ms and retains at most 0.5% by volume of carbides and at most 20% by volume of residual ferrite, wherein the sheet is at a temperature TP0 at the end of this transfer;

a first shaping or cutting step of the sheet is carried out for a period t1, during which period the sheet remains at a temperature greater than Ms and retains at most 0.5% by volume of carbides and at most 20% by volume of residual ferrite;

transfer of the shaped or cut sheet metal is carried out on a second shaping or cutting tool, or the configuration of the first shaping or cutting tool is modified for a period t2 during which period the sheet metal is cut while remaining at a temperature greater than Ms and retaining at most 0.5% by volume of carbides and at most 20% by volume of residual ferrite;

a second shaping or cutting step of the sheet is carried out for a period t3, during which period the sheet remains at a temperature greater than Ms and retains at most 0.5% by volume of carbides and at most 20% by volume of residual ferrite;

if TPn denotes the temperature reached by the shaped or cut sheet at the end of the last cutting or shaping step and/ti the sum of the periods of the transfer and/or tool configuration change steps and the shaping or cutting steps, the magnitude (TP0−TPn)/Σti is at least 0.5° C./s;

and the sheet is allowed to cool to ambient temperature in order to obtain the final part, wherein the final part has a microstructure containing at most 0.5% of carbides in volume fraction and at most 20% of residual ferrite in volume fraction.

2. The method according to claim 1, wherein the sheet has a martensitic transformation start temperature (Ms)≤400° C.

3. The method according to claim 2, wherein the martensitic transformation start temperature (Ms) of the sheet is between 390 and 220° C.

4. The method according to claim 1, wherein the thickness of the sheet is between 0.1 and 10 mm.

5. The method according to claim 1, wherein the austenitization temperature is at least 850° C.

6. The method according to claim 5, wherein the austenitization temperature is between 925 and 1200° C.

7. The method according to claim 1, wherein reheating of the sheet is effected during at least one of the transfer and/or tool configuration change steps or shaping or cutting steps of the sheet.

8. The method according to claim 1, wherein a surface treatment is performed on the final part that is intended to increase its roughness or its fatigue properties.

9. The method according to claim 1, wherein the final part is kept between 90 and 500° C. for 10 s to 1 h, and then allowed to cool naturally in air.

10. The method according to claim 1, wherein 10.5%≤Cr≤14.0%.

11. The method according to claim 1, wherein traces≤Cu≤0.5%.

12. The method according to claim 1, wherein traces≤H≤1 ppm.

13. The method according to claim 1, wherein other steps may be performed for transferring the cut or shaped sheet metal to other cutting or shaping tools, or to modifying the configuration of the shaping or cutting tool used in the preceding step, and wherein each operation is followed by a shaping or cutting step, and wherein the sheet remains at a temperature greater than Ms and retains at most 0.5% by volume of carbides and at most 20% by volume of residual ferrite during each of the steps of transferring the sheet or modifying the configuration of the tool and each of the shaping or cutting operations.

14. The method according to claim 1, wherein, before the sheet is allowed to cool, an additional shaping or cutting step is carried out at a temperature between Ms and Mf, in a domain where the microstructure consists of martensite, at least 5% of austenite and at most 20% of ferrite.

15. The method according to claim 1, wherein the size of the ferritic grains of the sheet is from 5 to 40 μm.

16. The method according to claim 1, wherein one or more hot transformations of the sheet is carried out.

17. The method according to claim 1, wherein one or more cold transformations of the sheet is carried out.

* * * * *